US011699864B2

(12) United States Patent
Harimochi et al.

(10) Patent No.: US 11,699,864 B2
(45) Date of Patent: Jul. 11, 2023

(54) RELAY

(71) Applicant: OMRON Corporation, Kyoto (JP)

(72) Inventors: Hiroyuki Harimochi, Kumamoto (JP); Ryota Minowa, Yamaga (JP); Naoki Kawaguchi, Yame (JP); Shinichi Ogawa, Kikuchi (JP); Kohei Otsuka, Omuta (JP); Hiroyuki Iwasaka, Kumamoto (JP); Kazuhiro Tsutsui, Kumamoto (JP)

(73) Assignee: OMRON CORPORATION, Kyoto (JP)

( * ) Notice: Subject to any disclaimer, the term of this patent is extended or adjusted under 35 U.S.C. 154(b) by 236 days.

(21) Appl. No.: 17/012,080

(22) Filed: Sep. 4, 2020

(65) Prior Publication Data

US 2021/0083404 A1 Mar. 18, 2021

(30) Foreign Application Priority Data

Sep. 18, 2019 (JP) ..... 2019-169238

(51) Int. Cl.
*H01H 13/04* (2006.01)
*H01R 4/38* (2006.01)
(Continued)

(52) U.S. Cl.
CPC ..... *H01R 4/38* (2013.01); *H01H 50/12* (2013.01); *H01H 50/14* (2013.01)

(58) Field of Classification Search
CPC ... H01R 4/38; H01R 4/42; H01R 4/44; H01R 4/46; H01H 50/12; H01H 50/14; H01H 1/62; H01H 50/045
(Continued)

(56) References Cited

U.S. PATENT DOCUMENTS 2,886,669 A * 5/1959 Kelto ..... H01H 50/305 335/131
2,889,426 A * 6/1959 Heller ..... H01H 50/22 335/131
(Continued)

FOREIGN PATENT DOCUMENTS

JP 6-208823 A 7/1994
JP 2013-222562 A 10/2013
(Continued)

OTHER PUBLICATIONS

The Office Action for the corresponding Japanese application No. 2019-169238, dated Apr. 4, 2023.

*Primary Examiner* — Shawki S Ismail
*Assistant Examiner* — Lisa N Homza
(74) *Attorney, Agent, or Firm* — Shinjyu Global IP

(57) ABSTRACT

A relay includes a housing, a fixed terminal, a screw receiving member, and at least one female screw member. The fixed terminal has a plate shape. The fixed terminal includes a fastening portion having at least one screw insertion hole. The fastening portion is exposed from the housing to an outside and is screwed to an external terminal. The screw receiving member overlaps with the fastening portion in a penetrating direction of the at least one screw insertion hole and is provided in proximity to the fastening portion. The at least one female screw member is provided integrally with or separately from the screw receiving member and is prevented from rotating by the screw receiving member.

13 Claims, 8 Drawing Sheets

(51) Int. Cl.
*H01H 50/12* (2006.01)
*H01H 50/14* (2006.01)

(58) Field of Classification Search
USPC ..... 335/202
See application file for complete search history.

(56) References Cited

U.S. PATENT DOCUMENTS 3,253,092 A * 5/1966 Landow ..... H01H 11/0012 200/16 A
4,710,740 A * 12/1987 Dennison ..... H01F 7/12 335/277
5,517,167 A * 5/1996 Yamamoto ..... H01H 50/443 335/132
5,892,194 A * 4/1999 Uotome ..... H01H 51/065 335/154
6,700,466 B1 * 3/2004 Yamamoto ..... H01H 9/302 335/201
8,138,863 B2 * 3/2012 Tanaka ..... H01H 50/38 335/131
8,138,872 B2 * 3/2012 Yoshihara ..... H01F 7/1615 335/185
8,237,524 B2 * 8/2012 Niimi ..... F02N 15/067 335/131
8,289,110 B2 * 10/2012 Niimi ..... F02N 11/087 335/126
8,305,169 B2 * 11/2012 Suzuki ..... F02N 11/087 335/131
8,390,408 B2 * 3/2013 Nawa ..... H01H 3/001 335/133
8,446,239 B2 * 5/2013 Niimi ..... H01H 51/065 335/131
8,659,372 B2 * 2/2014 Morimura ..... H01H 9/443 335/201
2002/0023768 A1 * 2/2002 Takami ..... H01H 50/14 174/59
2005/0179510 A1 * 8/2005 Iima ..... H01H 50/14 335/126
2011/0032059 A1 * 2/2011 Ito ..... H01H 50/14 218/25
2013/0033344 A1 * 2/2013 Morimura ..... H01H 9/443 335/179
2015/0022291 A1 1/2015 Kashimura et al.
2015/0187527 A1 * 7/2015 Kubono ..... H01H 50/18 335/189
2015/0213984 A1 7/2015 Naka et al.
2016/0254113 A1 * 9/2016 Nishimura ..... H01H 50/14 335/202
2019/0013171 A1 * 1/2019 Minowa ..... H01H 50/44
2019/0131093 A1 * 5/2019 Minowa ..... H01H 50/02
2019/0131094 A1 * 5/2019 Minowa ..... H01H 50/045
2019/0131096 A1 * 5/2019 Minowa ..... H01H 50/54
2019/0131097 A1 * 5/2019 Minowa ..... H01H 50/04
2019/0297720 A1 * 9/2019 Fujimura ..... H05K 1/0204
2019/0304727 A1 * 10/2019 Minowa ..... H01H 50/546
2019/0304729 A1 * 10/2019 Minowa ..... H01H 50/42
2019/0311871 A1 * 10/2019 Minowa ..... H01H 50/546
2019/0355536 A1 * 11/2019 Ozaki ..... H01H 9/443
2020/0051765 A1 * 2/2020 Hiramitsu ..... H05K 7/20263
2021/0375569 A1 * 12/2021 Ozaki ..... H01H 50/443

FOREIGN PATENT DOCUMENTS

JP 2014-110192 A 6/2014
JP 2014-120398 A 6/2014
JP 6110109 B2 4/2017

* cited by examiner

RELAY

CROSS-REFERENCE TO RELATED APPLICATION

This application claims priority to Japanese Patent Application No. 2019-169238, filed Sep. 18, 2019. The contents of that application are incorporated by reference herein in their entirety

FIELD

The present invention relates to a relay.

BACKGROUND

Conventionally, a relay that opens and closes an electric circuit is known. The relay includes a fixed terminal connected to an external terminal. For example, the fixed terminal of the relay disclosed in Japanese Laid-Open Patent Publication No. 2013-222562 includes a cylindrical terminal and a plate shape terminal fixed to the cylindrical terminal, and the plate shape terminal is connected to the external terminal by screw fastening.

SUMMARY

In the relay disclosed in Japanese Laid-Open Patent Publication No. 2013-222562, a male screw member is joined to the fixed terminal in advance, and the male screw member protrudes from the fixed terminal. Therefore, for example, during transportation, the male screw member is likely to come into contact with other members and be damaged.

Further, in a relay disclosed in Japanese Patent No. 6110109, a columnar terminal is connected to a plate shape fixed terminal arranged inside the relay. Therefore, the manufacturing cost of the relay increases due to the increase of the manufacturing process and the number of parts.

An object of the present invention is to provide an inexpensive relay that can be easily connected to an external terminal with a fixed terminal having a plate shape by screw fastening.

A relay according to one aspect of the present invention includes a housing, a fixed terminal, a screw receiving member, and at least one female screw member. The fixed terminal has a plate shape. The fixed terminal includes a fastening portion having at least one screw insertion hole. The fastening portion is exposed from the housing to an outside and is screwed to an external terminal. The screw receiving member overlaps with the fastening portion in a penetrating direction of the at least one screw insertion hole and is provided in proximity to the fastening portion. The at least one female screw member is provided integrally with or separately from the screw receiving member and is prevented from rotating by the screw receiving member.

In this relay, the screw receiving member prevents the at least one female screw member from rotating, overlaps with the fastening portion in the penetrating direction of the screw insertion hole, and is provided in proximity to the fastening portion. Therefore, a male screw member such as a bolt can be screwed into the at least one female screw by inserting the male screw member through the at least one screw insertion hole. Accordingly, the fixed terminal having a plate shape can be easily connected to the external terminal by screw fastening. That is, it is possible to provide an inexpensive relay in which the external terminal and the fixed terminal can be connected by a simple assembling means. Further, the bending of the fixed terminal can be suppressed by the screw receiving member. In addition, the possibility that the relay will be damaged can be reduced as compared with the case where the male screw member protrudes from the fixed terminal.

The at least one female screw member may be provided separately from the screw receiving member. The screw receiving member may hold the at least one female screw member to prevent rotation. In this case, the fixed terminal having a plate shape can be easily connected to the external terminal by screw fastening while suppressing the bending of the fixed terminal by the screw receiving member.

The at least one female screw member may be a nut. In this case, the fixed terminal having a plate shape can be more easily connected to the external terminal by screw fastening.

The fastening portion may protrude to the outside from the housing. The screw receiving member may be integrated with the housing. In this case, since the screw receiving member is integrated with the housing, the number of parts can be reduced, and the fixed terminal having a plate shape can be more easily connected to the external terminal by screw fastening.

The fixed terminal may have a shape bent in a C shape. The screw receiving member may be arranged inside the housing. In this case, in the fixed terminal having a shape bent in a C shape, the external terminal can be easily connected by screw fastening.

The fixed terminal may have a shape bent in an L shape. In this case, in the fixed terminal having a shape bent in an L shape, the external terminal can be easily connected by screw fastening.

The fastening portion may be exposed to the outside along a side surface of the housing. The at least one screw insertion hole may penetrate in a thickness direction of the fastening portion. In this case, the external terminal can be easily connected by screw fastening.

The at least one screw insertion hole may include a plurality of the screw insertion holes. The at least one female screw member may include a plurality of the female screw members provided integrally with or separately from the screw receiving member. In this case, an additional external terminal can be connected to the relay for the purpose of detection or the like different from the external terminal for energization.

At least a part of an outer edge of the screw receiving member may be located outside beyond an outer edge of the fastening portion. In this case, the fastening portion can be prevented from coming into contact with other members by the screw receiving member.

The screw receiving member may include a heat dissipation portion for dissipating heat generated by the fixed terminal. The heat dissipating portion may be recessed in a direction from the fastening portion toward the screw receiving member. In this case, the heat generated by the fixed terminal can be effectively dissipated.

The at least one female screw member may be sandwiched between the fastening portion and the screw receiving member. In this case, the female screw member can be prevented from falling outside.

DETAILED DESCRIPTION

Figure 3:
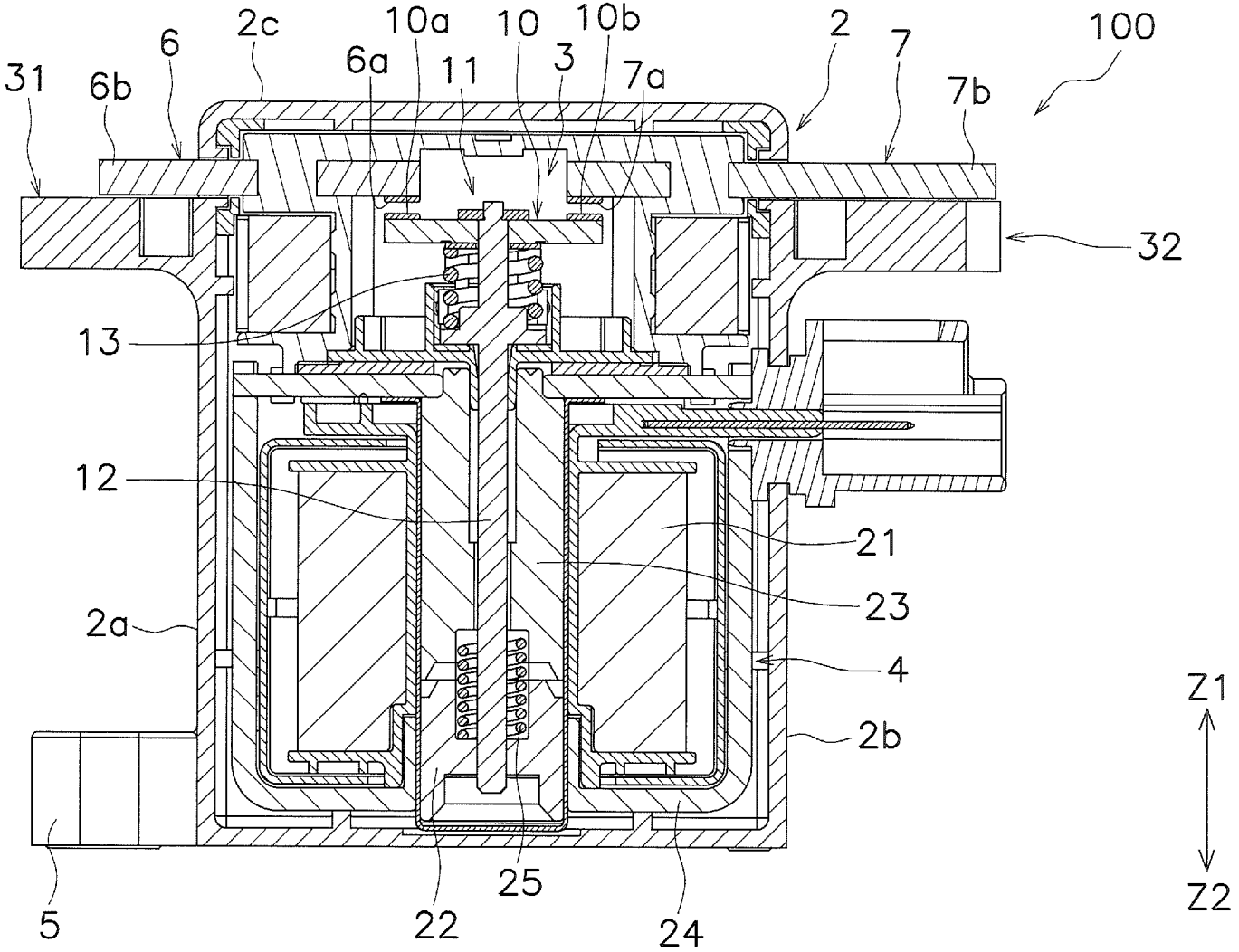
FIG. 3 is a sectional view taken along line III-III of FIG. 2.

Hereinafter, embodiment of a relay 100 according to one aspect of the present invention will be described with reference to the drawings. Hereinafter, an example of the relay according to the embodiment will be described with reference to the drawings. When referring to the drawings, an upper side in FIG. 3 is referred to as "up", a lower side is referred to as "down", a left side is referred to as "left", and a right side is referred to as "right" in order to facilitate understanding of the description. These directions are defined for convenience of explanation, and do not limit an arrangement direction of the relay 100.

The relay 100 includes a housing 2, a contact device 3, and a drive device 4.

The housing 2 has a substantially rectangular box shape and is made of an insulating material. The contact device 3 and the drive device 4 are housed inside the housing 2. The housing 2 is provided with a pair of mounting portions 5 protruding from lower portions of a left and right side portions 2*a*, 2*b*.

The contact device 3 includes a first fixed terminal 6, a second fixed terminal 7, a movable contact piece 10, and a movable mechanism 11.

Each of the first fixed terminal 6 and the second fixed terminal 7 is an example of a fixed terminal. The first fixed terminal 6 and the second fixed terminal 7 are plate-shaped terminals and extend in the left-right direction. The first fixed terminal 6 and the second fixed terminal 7 extend both inside and outside the housing 2. The first fixed terminal 6 and the second fixed terminal 7 are arranged apart from each other in the left-right direction. The first fixed terminal 6 and the second fixed terminal 7 are made of a conductive material.

The first fixed terminal 6 includes a first fixed contact 6*a* and a first fastening portion 6*b*. The first fixed contact 6*a* is arranged inside the housing 2. The first fixed contact 6*a* is provided separately from the first fixed terminal 6. The first fixed contact 6*a* may be integrated with the first fixed terminal 6.

The first fastening portion 6*b* is an example of a fastening portion. The first fastening portion 6*b* protrudes from the housing 2 to the outside. The first fastening portion 6*b* in the present embodiment protrudes leftward from near an upper portion of the left side portion 2*a* of the housing 2. The first fastening portion 6*b* is connected to an external terminal 30 (see FIG. 4) such as a bus bar by screw fastening. The first fastening portion 6*b* has a first screw insertion hole 6*c* penetrating in the up-down direction.

The second fixed terminal 7 includes a second fixed contact 7*a* and a second fastening portion 7*b*. The second fixed contact 7*a* is arranged inside the housing 2. The second fixed contact 7*a* is provided separately from the second fixed terminal 7. The second fixed contact 7*a* may be integrated with the second fixed terminal 7.

The second fixed contact 7*a* is arranged inside the housing 2. The second fastening portion 7*b* is an example of a fastening portion. The second fastening portion 7*b* protrudes from the housing 2 to the outside. The second fastening portion 7*b* in the present embodiment protrudes rightward from near an upper portion of the right side portion 2*b* of the housing 2. The second fastening portion 7*b* is connected to an external terminal such as a bus bar by screw fastening. The second fastening portion 7*b* has a second screw insertion hole 7*c* penetrating in the up-down direction.

The movable contact piece 10 is a plate shape member that is long in one direction, and extends in the left-right direction inside the housing 2. The movable contact piece 10 is made of a conductive material. The movable contact piece 10 is movable in a contact direction Z1 and a separation direction Z2. The contact direction Z1 is a direction in which the movable contact piece 10 approaches the first fixed contact 6*a* and the second fixed contact 7*a* (upward in FIG. 3). The separation direction Z2 is a direction (downward in FIG. 3) in which the movable contact piece 10 separates from the first fixed contact 6*a* and the second fixed contact 7*a*. Therefore, the contact direction Z1 and the separation direction Z2 are parallel to the up-down direction.

The movable contact piece 10 includes a first movable contact 10*a* and a second movable contact 10*b*. The first movable contact 10*a* is arranged at a position facing the first fixed contact 6*a*. The second movable contact 10*b* is arranged at a position facing the second fixed contact 7*a*. The first movable contact 10*a* and the second movable contact 10*b* are provided separately from the movable contact piece 10. The movable contacts 10*a*, 10*b* may be integrated with the movable contact piece 10.

The movable mechanism 11 includes a drive shaft 12 and a contact spring 13. The drive shaft 12 extends in the up-down direction and penetrates the movable contact piece 10 in the up-down direction. The drive shaft 12 is provided so as to be movable in the contact direction Z1 and the separation direction Z2. The contact spring 13 urges the movable contact piece 10 in the contact direction Z1.

The drive device 4 moves the movable mechanism 11 in the contact direction Z1 and the separation direction Z2 by an electromagnetic force. The drive device 4 includes a coil 21, a movable iron core 22, a fixed iron core 23, a yoke 24, and a return spring 25.

When a voltage is applied and the coil 21 is excited, the coil 21 generates the electromagnetic force that moves the movable iron core 22 in the contact direction Z1. The movable iron core 22 is coupled to the drive shaft 12 so as to be integrally movable. The fixed iron core 23 is arranged at a position facing the movable iron core 22. The yoke 24 is arranged so as to surround the coil 21. The return spring 25 is arranged between the movable iron core 22 and the fixed iron core 23. The return spring 25 urges the movable iron core 22 in the separation direction Z2.

The relay 100 further includes a first screw receiving member 31, a second screw receiving member 32, a first female screw member 33, and a second female screw member 34. Each of the first screw receiving member 31 and the second screw receiving member 32 is an example of screw receiving member. Each of the first female screw member 33 and the second female screw member 34 is an example of at least one female screw member.

Figure 1:
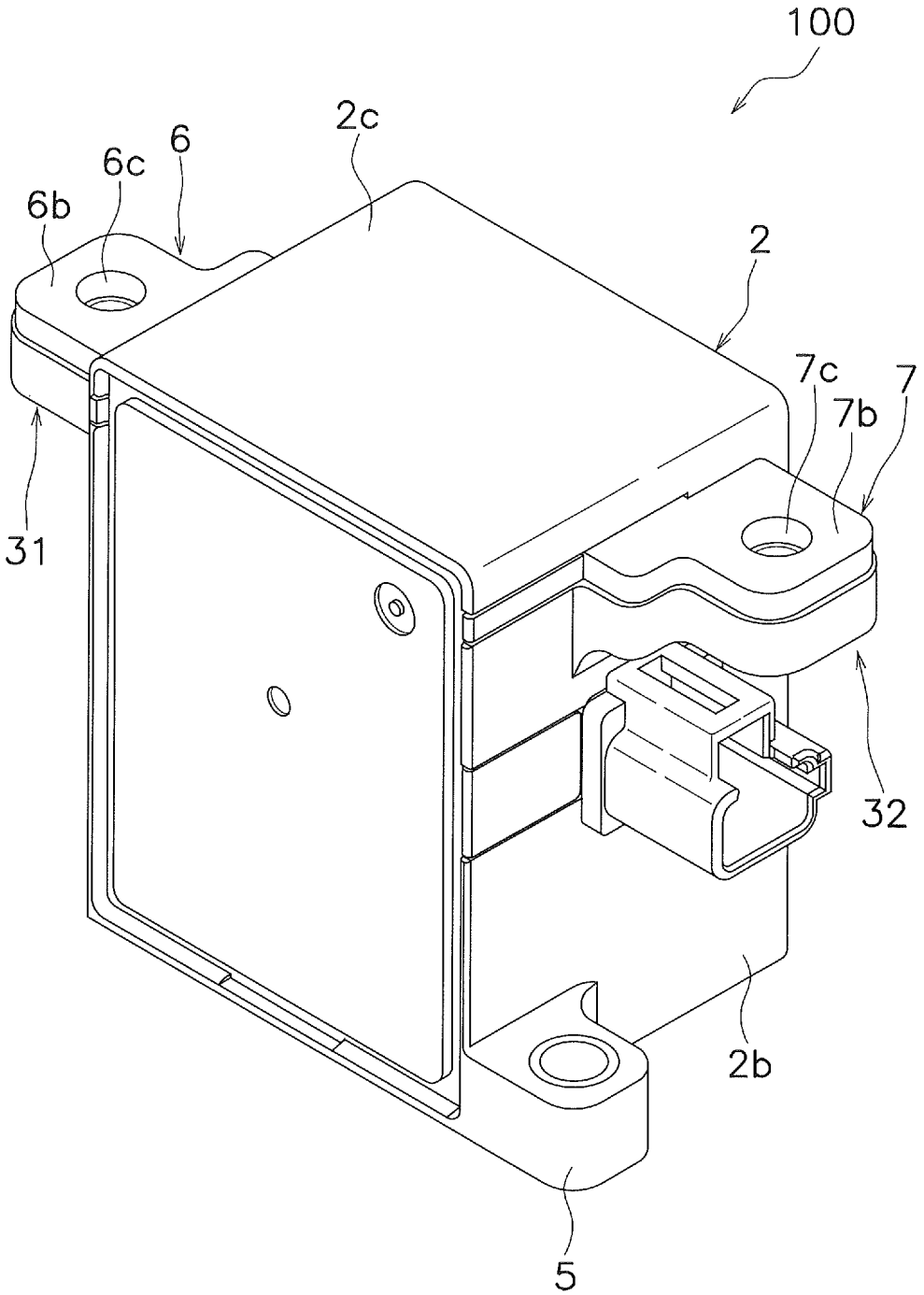
FIG. 1 is a perspective view of a relay.
Figure 2:
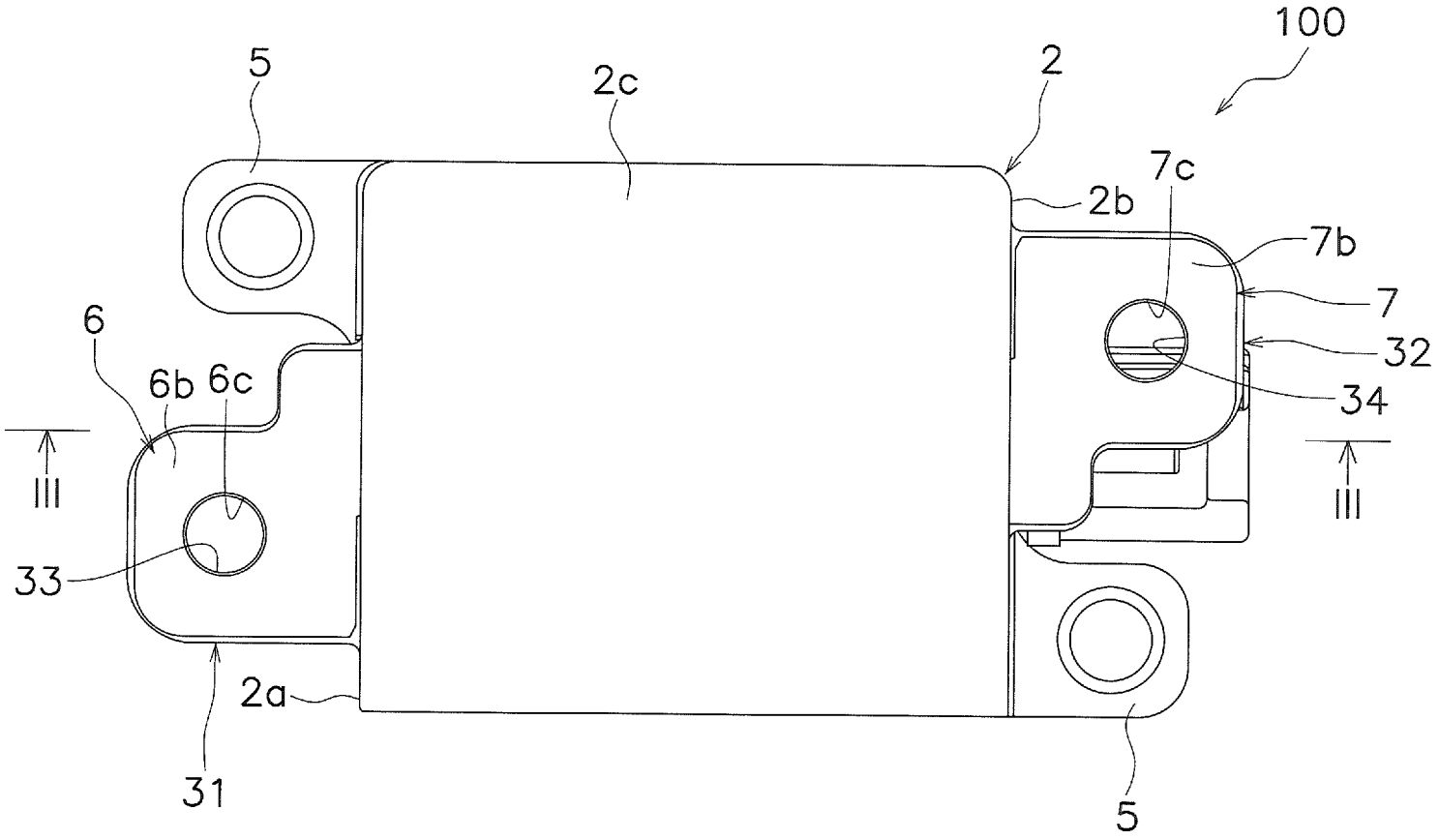
FIG. 2 is a view of the relay as viewed from above

The first screw receiving member 31 is integrated with the housing 2 and protrudes leftward from the left side portion 2*a* of the housing 2. As illustrated in FIG. 2, the first screw receiving member 31 overlaps the first fastening portion 6*b* in a penetrating direction of the first screw insertion hole 6*c*.

Figure 4:
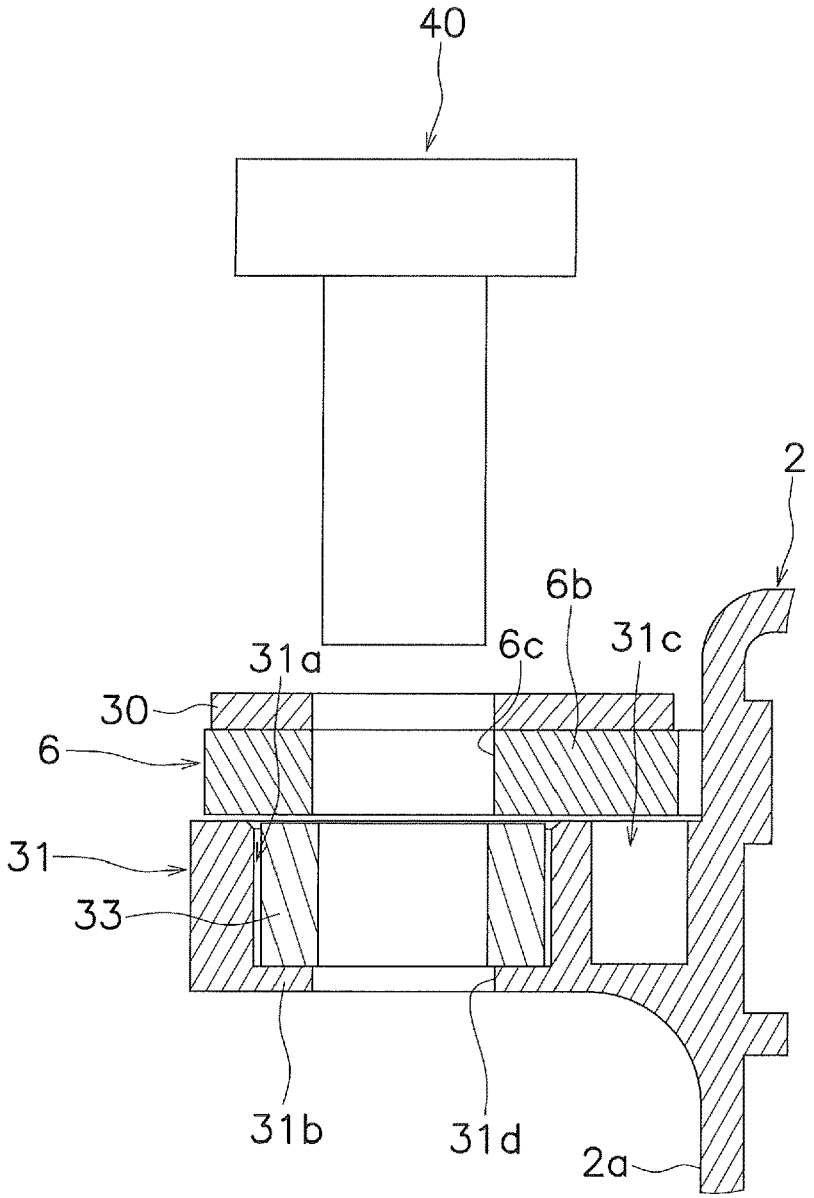
FIG. 4 is a cross-sectional view near a first screw insertion hole.

In the present embodiment, the first screw receiving member 31 overlaps the first fastening portion 6*b* in the up-down direction as seen in a plan view. At least a part of an outer edge of the first screw receiving member 31 is located outside beyond an outer edge of the first fastening portion 6*b*. In this embodiment, as illustrated in FIGS. 2 and 4, the first screw receiving member 31 extends leftward and in the up-down direction beyond the first fastening portion 6*b*, and the entire outer edge of the first screw receiving member 31 located outside beyond the outer edge of the first fastening portion 6*b*. Therefore, in the plan view, the entire first fastening portion 6*b* overlaps the first screw receiving member 31 in the up-down direction. The first screw receiving member 31 is provided in proximity to the first fastening portion 6*b*. In the present embodiment, the first screw receiving member 31 is arranged below the first fastening portion 6*b* and adjacent to the first fastening portion 6*b*.

As illustrated in FIG. 4, the first screw receiving member 31 includes a holding portion 31*a*. The holding portion 31*a* is formed to be recessed downward in a hexagonal shape and holds the first female screw member 33 to prevent rotation. A hole 31*d* for inserting a male screw member 40 such as a bolt is formed in a bottom portion 31*b* of the holding portion 31*a*. The hole 31*d* is not always necessary and may be omitted.

The first screw receiving member 31 includes a heat dissipation portion 31*c* for dissipating heat generated by the first fixed terminal 6. The heat dissipation portion 31*c* is formed to be recessed in a direction from the first fastening portion 6*b* toward the first screw receiving member 31. Specifically, the heat dissipation portion 31*c* is formed be recessed downward at a position different from the holding portion 31*a*. A gap is provided between the heat dissipation portion 31*c* and the first fastening portion 6*b* for facilitating release of heat generated by the first fixed terminal 6 to the outside. The heat dissipation portion 31*c* may be omitted. Further, a member for heat dissipation may be put in the heat dissipation portion 31*c*.

The second screw receiving member 32 is integrated with the housing 2 and protrudes rightward from the right side portion 2*b* of the housing 2. The second screw receiving member 32 holds the second female screw member 34 to prevent rotating. The second screw receiving member 32 has the same shape as the first screw receiving member 31 and is different only in the arrangement from the first screw receiving member 31, and thus detailed description thereof will be omitted.

As illustrated in FIG. 4, the first female screw member 33 is provided separately from the first screw receiving member 31. The first female screw member 33 in the present embodiment is a hexagonal nut screwed to the male screw member 40. The first female screw member 33 is fitted in the holding portion 31*a* and is prevented from rotating by the holding portion 31*a*. The first female screw member 33 is arranged between the bottom portion 31*b* of the holding portion 31*a* and the first fastening portion 6*b*. The first female screw member 33 is sandwiched between the first fastening portion 6*b* and the first screw receiving member 31. The upward movement of the first female screw member 33 is restricted by the first fastening portion 6*b*. A downward movement of the first female screw member 33 is restricted by the bottom portion 31*b* of the holding portion 31*a*.

The second female screw member 34 is prevented from rotating by the second screw receiving member 32. The second female screw member 34 has the same shape as the first female screw member 33, and is a hexagonal nut screwed to the male screw member 40. Detailed description of the second female screw member 34 is omitted.

In the relay 100 having configured as described above, the first screw receiving member 31 prevents the first female screw member 33 from rotating, overlaps the first fastening portion 6*b* in the penetrating direction of the first screw insertion hole 6*c*, and is provided in proximity to the first fastening portion 6*b*. Therefore, the male screw member 40 can be screwed into the first female screw member 33 by inserting the male screw member 40 through the first screw insertion hole 6*c*. Thereby, the first fixed terminal 6 having a plate shape can be easily connected to the external terminal 30 by screw fastening. That is, it is possible to provide the inexpensive relay 100 in which the external terminal 30 and the first fixed terminal 6 can be connected by a simple assembling means. Further, the bending of the first fixed terminal 6 can be suppressed by the first screw receiving member 31. The same effect can be obtained on the second fixed terminal 7 side as well.

While the embodiment of the electromagnetic relay according to one aspect of the present invention has been described, the present invention should not be construed as being limited thereto, and various types of modifications may be made without departing from the spirit or scope of the general inventive concept of the invention.

For example, the present invention may be applied to a relay in which the first fixed terminal 6 includes a columnar terminal and a plate shape terminal, and the plate shape terminal is connected to the columnar terminal. Further, the shape of the fixed terminal is not limited to the above-mentioned embodiment, and for example, the first fixed terminal 6 and the second fixed terminal 7 may have a shape in an L shape.

In the above-mentioned embodiment, the holding portion 31*a* of the first screw receiving member 31 has a hexagonal shape, but the shape of the holding portion 31*a* is not limited to this. The holding portion 31*a* may have any shape as long as it can prevent the first female screw member 33 from rotating. The first female screw member 33 may be embedded in the first screw receiving member 31 by insert molding, for example. The configuration of the second screw receiving member 32 is not limited to the above embodiment, and these configurations may be applied to the second screw receiving member 32.

Figure 5:
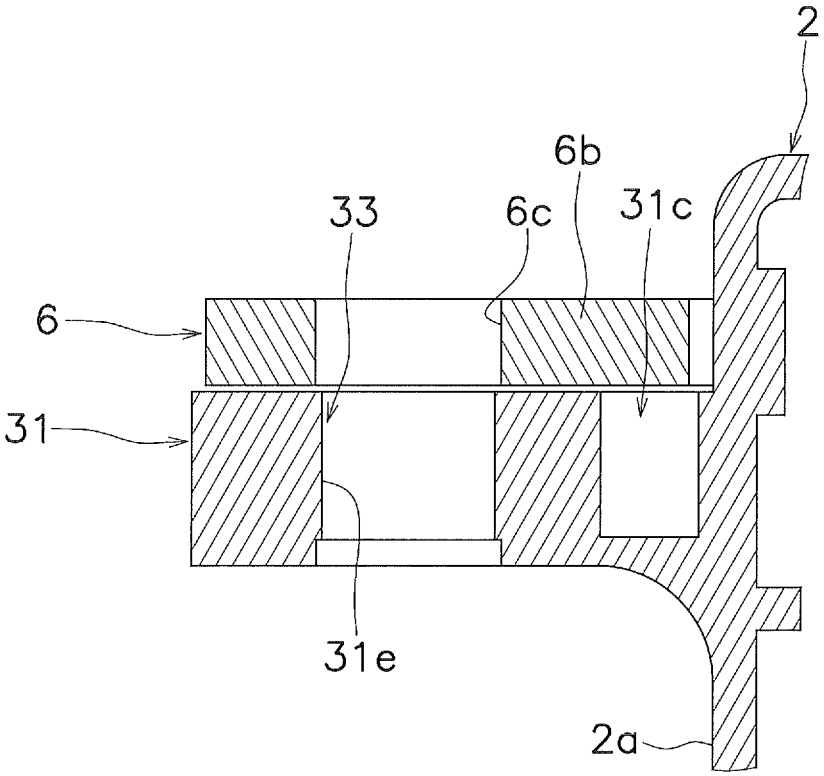
FIG. 5 is a cross-sectional view near the first screw insertion hole according to a modification.

In the above-mentioned embodiment, the first female screw member 33 is provided separately from the first screw receiving member 31, but as illustrated in FIG. 5, the first female screw member 33 may be integrated with the first screw receiving member 31. In this case, a female screw portion 31*e* corresponding to the first female screw member 33 is formed on the inner peripheral side of the first screw receiving member 31. Similarly, the second female screw member 34 may be integrated with the second screw receiving member 32.

Figure 6:
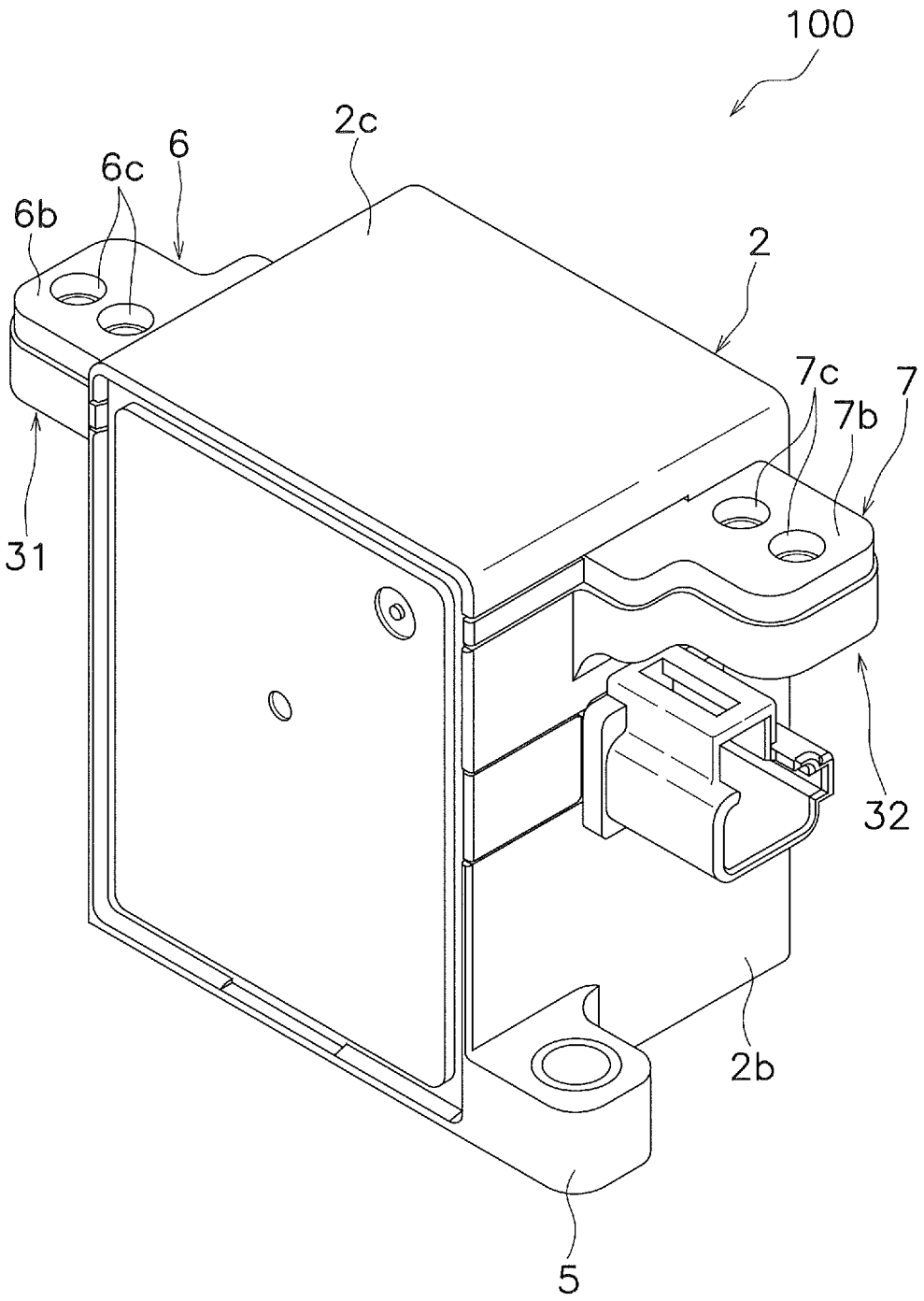
FIG. 6 is a perspective view of the relay according to a modification.

As illustrated in FIG. 6, a plurality of first screw insertion holes 6*c* may be provided in the first fastening portion 6*b*. A plurality of second screw insertion holes 7*c* may be provided in the second fastening portion 7*b*. In this case, a plurality of first female screw members 33 and second female screw members 34 are provided in correspondence with the numbers of the first screw insertion holes 6*c* and the second screw insertion holes 7*c*. In this case, an additional external terminal can be connected to the relay for the purpose of detection or the like different from the external terminal for energization.

Figure 7:
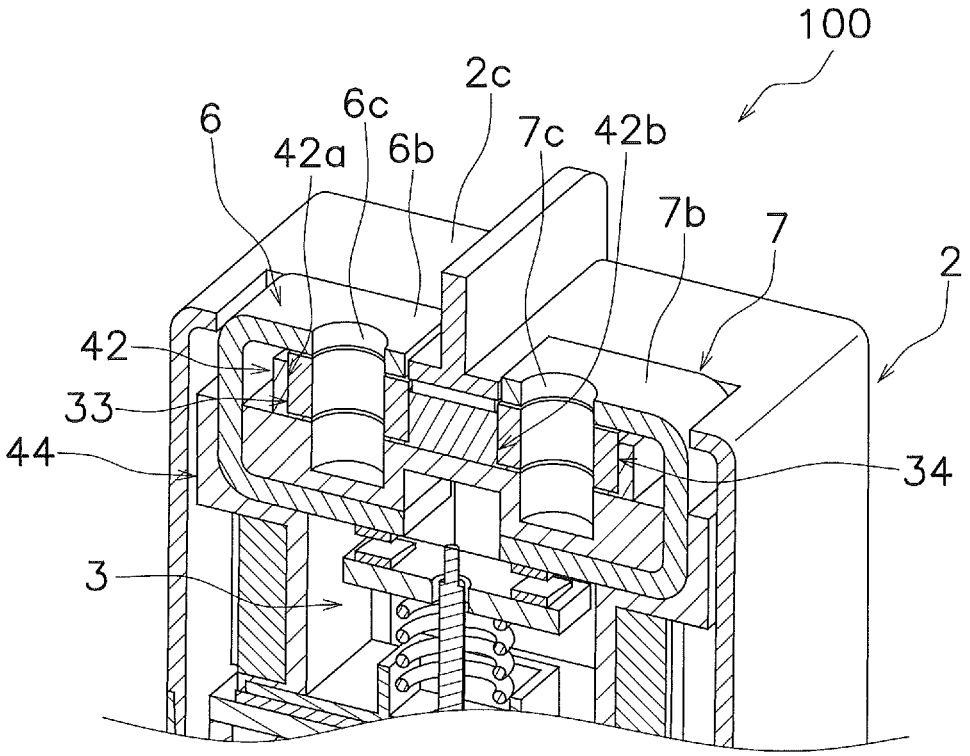
FIG. 7 is a cross-sectional perspective view of the relay according to a modification.

FIG. 7 is a cross-sectional perspective view of the relay 100 according to a first modification. In the first modification, the configurations of the first fixed terminal 6, the second fixed terminal 7, the first screw receiving member 31, and the second screw receiving member 32 are different from those of the above-described embodiment. The first fixed terminal 6 and the second fixed terminal 7 have a shape bent in a C shape. The first fastening portion 6*b* and the second fastening portion 7*b* are exposed to the outside from an upper portion 2*c* of the housing 2.

The screw receiving member 42 is arranged inside the housing 2. Specifically, the screw receiving member 42 is arranged between the upper portion 2*c* of the housing 2 and the contact case 44 in which the contact device 3 is housed. The screw receiving member 42 has a rectangular parallelepiped in an outer shape, and is made of, for example, an insulating material such as resin.

The screw receiving member 42 includes a first holding portion 42*a* and a second holding portion 42*b*. The first holding portion 42*a* and the second holding portion 42*b* are formed to be recessed downward in a hexagonal shape. The first holding portion 42*a* holds the first female screw member 33 to prevent rotation. The second holding portion 42*b* holds the second female screw member 34 to prevent rotation. Also in the first modified example, the same effect as that of the above-described embodiment can be obtained.

Figure 8:
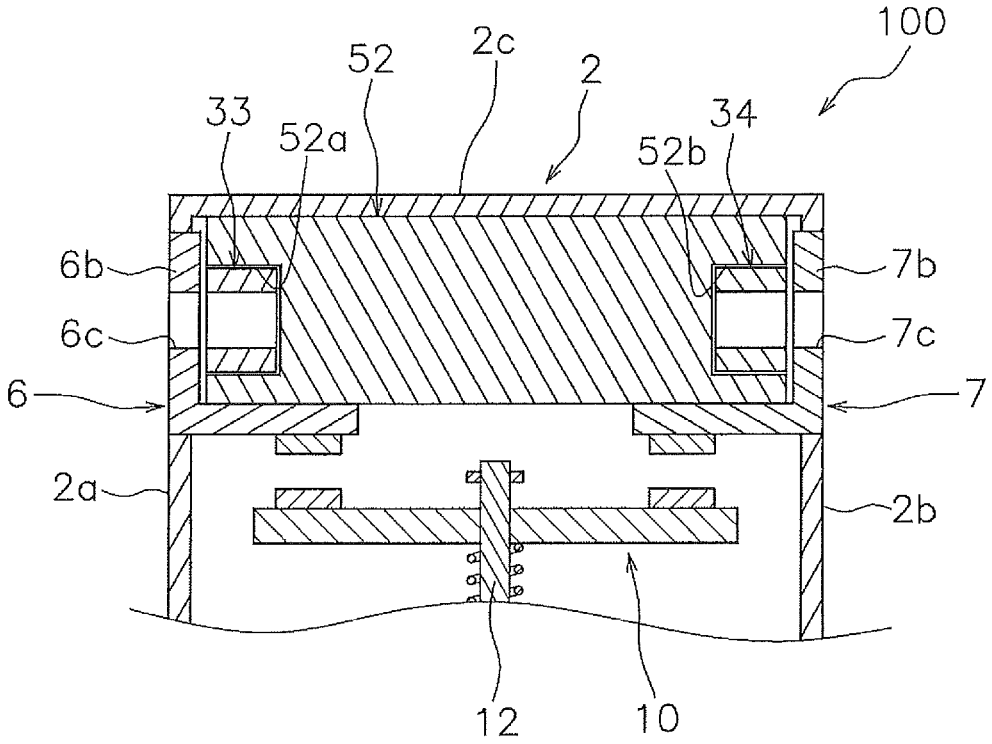
FIG. 8 is a schematic sectional view of the relay according to a modification.

FIG. 8 is a schematic sectional view of the relay 100 according to a second modification. Here, the first fixed terminal 6 and the second fixed terminal 7 have a shape bent in an L shape. The first fastening portion 6*b* is exposed to the outside along a side surface of the left side portion 2*a* of the housing 2. The first screw insertion hole 6*c* is formed penetrating in a thickness direction of the first fastening portion 6*b*. Here, the first screw insertion hole 6*c* is formed penetrating in the left-right direction. Therefore, the first female screw member 33 overlaps the first screw insertion hole 6*c* in the left-right direction, and the male screw member that is screwed into the first female screw member 33 from the left side 2*a* side of the housing 2 is inserted into the first screw insertion hole 6*c*.

A screw receiving member 52 includes a first holding portion 52*a* and a second holding portion 52*b*. The first holding portion 52*a* and the second holding portion 52*b* are formed to be recessed in a direction from the side portions 2*a*, 2*b* of the housing 2 toward the inside of the housing 2. The first holding portion 52*a* and the second holding portion 52*b* are formed in a hexagonal shape so as to be recessed in the left-right direction. The first holding portion 52*a* holds the first female screw member 33 to prevent rotation. The second holding portion 52*b* holds the second female screw member 34 to prevent rotation. The arrangement of the first fixed terminal 6, the arrangement of the second fixed terminal 7, the arrangement of the first holding portion 52*a*, and the arrangement of the second holding portion 52*b* may be changed. Further, the first holding portion 52*a* and the second holding portion 52*b* may be provided on separate members. The first holding portion 52*a* and the second holding portion 52*b* may be formed, for example, so as to be recessed in a direction from the side portion located in the front-rear direction of the housing toward the inside of the housing 2.

The invention claimed is:

1. A relay comprising:

a housing;

a fixed terminal having a plate shape, the fixed terminal including a fastening portion, the fastening portion having at least one screw insertion hole, the fastening portion being exposed from the housing to an outside, the fastening portion being screwed to an external terminal;

a screw receiving member that overlaps with the fastening portion in a penetrating direction of the at least one screw insertion hole and is provided in proximity to the fastening portion; and at least one female screw member that is provided integrally with or separately from the screw receiving member and is prevented from rotating by the screw receiving member, wherein the screw receiving member has a first surface, a second surface on an opposite side to the first surface, and a hole to insert a male screw member which screws with the at least one female screw member, the hole extending from the first surface to the second surface in the penetrating direction.

2. The relay according to claim 1, wherein the at least one female screw member is provided separately from the screw receiving member, and the screw receiving member holds the at least one female screw member to prevent rotation.

3. The relay according to claim 2, wherein the at least one female screw member is a nut.

4. The relay according to claim 1, wherein the fastening portion protrudes to the outside from the housing, and the screw receiving member is integrated with the housing.

5. The relay according to claim 1, wherein the fixed terminal has a shape bent in a C shape, and the screw receiving member is arranged inside the housing.

6. The relay according to claim 1, wherein the fixed terminal has a shape bent in an L shape.

7. The relay according to claim 6, wherein the fastening portion is exposed to the outside along a side surface of the housing, and the at least one screw insertion hole penetrates in a thickness direction of the fastening portion.

8. The relay according to claim 1, wherein the at least one screw insertion hole includes a plurality of screw insertion holes, and the at least one female screw member includes a plurality of female screw members provided integrally with or separately from the screw receiving member.

9. The relay according to claim 1, wherein at least a part of an outer edge of the screw receiving member is located outside beyond an outer edge of the fastening portion.

10. The relay according to claim 1, wherein the screw receiving member includes a heat dissipation portion for dissipating heat generated by the fixed terminal, and the heat dissipation portion is recessed in a direction from the fastening portion toward the screw receiving member.

11. The relay according to claim 10, wherein the at least one female screw member is provided separately from the screw receiving member, the heat dissipation portion includes an opening that opens toward the fixed terminal, and the fixed terminal covers at least a part of the opening.

12. The relay according to claim 1, wherein the at least one female screw member is sandwiched between the fastening portion of the fixed terminal and the screw receiving member.

13. The relay according to claim 1, wherein the at least one female screw member is provided separately from the screw receiving member, and the fastening portion is configured to regulate movement of the at least one female screw member in a direction from the screw receiving member to the fastening portion.

* * * * *